US006220318B1

(12) United States Patent
Pinti

(10) Patent No.: US 6,220,318 B1
(45) Date of Patent: Apr. 24, 2001

(54) PURSE WITH PANEL PERMITTING CUSTOM DECORATION

(76) Inventor: David T. Pinti, 1808 Elk Spring Dr., Brandon, FL (US) 33511

( * ) Notice: Subject to any disclaimer, the term of this patent is extended or adjusted under 35 U.S.C. 154(b) by 0 days.

(21) Appl. No.: 09/500,100

(22) Filed: Feb. 8, 2000

(51) Int. Cl.[7] ..... A45C 1/00; A45C 13/08

(52) U.S. Cl. ..... 150/103; 150/104; 383/106

(58) Field of Search ..... 446/146; 434/85, 434/150; 383/106; 150/106, 103, 104

(56) References Cited

U.S. PATENT DOCUMENTS

| | | | | |
|---|---|---|---|---|
| 1,624,987 | | 4/1927 | Shillman . | |
| 2,518,572 | | 8/1950 | Sanders . | |
| 2,791,040 | * | 5/1957 | Santorelli | 383/106 X |
| 2,920,671 | | 1/1960 | Siris et al. . | |
| 3,376,962 | * | 4/1968 | Adams | 190/109 |
| 3,556,187 | | 1/1971 | Speakes . | |
| 3,867,971 | * | 2/1975 | Hazan | 150/104 |
| 4,022,261 | * | 5/1977 | Russell | 383/106 X |
| 4,171,717 | | 10/1979 | Fleming . | |
| 4,669,587 | * | 6/1987 | Zitt | 383/106 X |
| 4,685,570 | * | 8/1987 | Medow | 190/901 X |
| 5,533,558 | | 7/1996 | Carey et al. . | |

FOREIGN PATENT DOCUMENTS

| | | | | |
|---|---|---|---|---|
| 2406969 | * | 6/1979 | (FR) | 150/104 |

* cited by examiner

*Primary Examiner*—Sue A. Weaver
(74) *Attorney, Agent, or Firm*—Larson & Larson, P.A.; James E. Larson

(57) ABSTRACT

A purse has a rear panel made of a dry erasable material on which the user can draw a design that can, as desired, be modified or erased or otherwise changed or altered. The dry erasable material panel also can be decorated by affixing decorative materials such as facial features, artificial hair, ornamentation such as sequins, rhinestones, or any other decorative material. A transparent flap overlies the dry erasable material panel and is fastened in a position overlying the panel through any suitable fastener such as, for example, hook and pile fastening system, snaps, hooks, adhesive or the like. The purse can have a carrying strap.

15 Claims, 3 Drawing Sheets

PURSE WITH PANEL PERMITTING CUSTOM DECORATION

BACKGROUND OF THE INVENTION

The present invention relates to a purse with a panel permitting custom decoration. In the prior art, it is known to provide a purse, handbag or other article carrying device including the provision of structure allowing one to customize the outward appearance thereof. However, Applicant is unaware of any such device including all of the features and aspects of the present invention.

The following prior art is known to Applicant:

U.S. Pat. No. 1,624,987 to Shillman discloses a pocketbook capable of being decorated and including an auxiliary flap permanently attached at a top portion thereof and having an area substantially equal to that of a side portion of the pocketbook. Means are provided for removably attaching the cover at opposed side portions and a bottom portion of the flap to the body of the pocketbook. The auxiliary flap can be decorated by painting, embroidering or sewing.

U.S. Pat. No. 2,518,572 to Sanders discloses a lady's handbag capable of being decorated. The main body of the handbag has a pair of frames and a pair of window apertures are provided in the side walls of the main body. Decorations such as cloth can be inserted into the area underneath each window aperture for display therethrough.

U.S. Pat. No. 2,920,671 to Siris et al. discloses a pocketbook having pockets for carrying and displaying indicia. A transparent pocket is provided on an outer wall of the pocketbook with the pocket having an open end for inserting decorations therein.

U.S. Pat. No. 3,556,187 to Speakes discloses a ladies' handbag having a transparent covering on a side portion thereof with an open end at the bottom for inserting decorations within a pocket formed by the transparent covering. If desired, the decorations can be attached to insertable panels having a size substantially equal to the area of the pocket within the transparent covering. Extensions are provided at a bottom portion of the handbag for closing the open end of the covering after a decorated panel has been inserted within the pocket.

U.S. Pat. No. 4,171,717 to Fleming discloses a handbag capable of color changes to the exterior surface thereof. The Fleming bag is constructed from dual-opposed compartments connected to each other by hinges. Each compartment comprises a C-shaped sidewall with a top and bottom wall connected thereto. Rotative spools are provided within the compartments with a roll of material being supplied on the spools and passing around the exterior surface of the handbag. The material can be provided with diverse colors and/or designs with the material being rotated through the bag to display the desired portion and/or color. The bag further provides top and bottom walls having display windows formed therein. Such windows can display insertable panels which can match the color or design displayed on the exterior surface as provided by the rotatable spools.

U.S. Pat. No. 5,533,558 to Carey et al. discloses a purse having an interchangeable decorative covering. The bag contains a large pocket area contained within opposed sidewalls accessible from a top portion of the bag with the pocket area being used for traditional purposes such as carrying of personal items. A removable covering is attachable to the outer surface of the bag such that both sidewalls and a bottom surface of the bag are covered. The covering is affixed to the bag by first and second clamps along the edges of the sidewalls.

The present invention differs from the teachings of the above-discussed United States Patents as contemplating the use of a dry erasable surface that is drawn on with special erasable markers and to which decorative items can be attached.

SUMMARY OF THE INVENTION

The present invention relates to a purse with a panel permitting custom decoration. The present invention includes the following interrelated objects, aspects and features:

(1) In a first aspect, the present invention consists of a purse having an inner compartment that may be used to store various items. If desired, the inner compartment may be subdivided into a plurality of sub-compartments as is well known in purses. The particular configuration of compartments and sub compartments within the purse of the present invention is typical of known purses. The inner compartment of the purse has an upwardly facing opening that is covered by a flap that may be releasably fastened using a clasp as is well known.

(2) The inventive purse has a rear panel opposed to the front panel of the purse where the clasp is located, which rear panel is made of a dry erasable material on which the user may draw a design that can be modified or erased or otherwise changed or altered.

(3) The dry erasable material panel can be decorated by affixing thereto decorative materials such as facial features, artificial hair, ornamentation such as sequins, rhinestones, or any other suitable decorative material.

(4) A transparent flap overlies the dry erasable material panel and is releasably fastened in a position overlying the panel through any suitable fastener such as, for example, hook and pile fastening means, snaps, hooks, adhesive or the like.

(5) The inventive purse can have a carrying strap as is well known to those skilled in the art.

Accordingly, it is a first object of the present invention to provide a purse with a panel permitting custom decoration.

It is a further object of the present invention to provide such a purse wherein the panel is made of a dry erasable material.

It is a still further object of the present invention to provide such a purse wherein the panel has a transparent flap overlying it, which flap is releasably fastened thereover.

It is a still further object of the present invention to provide such a purse wherein the dry erasable material panel is decorated by affixing decorative materials thereon.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
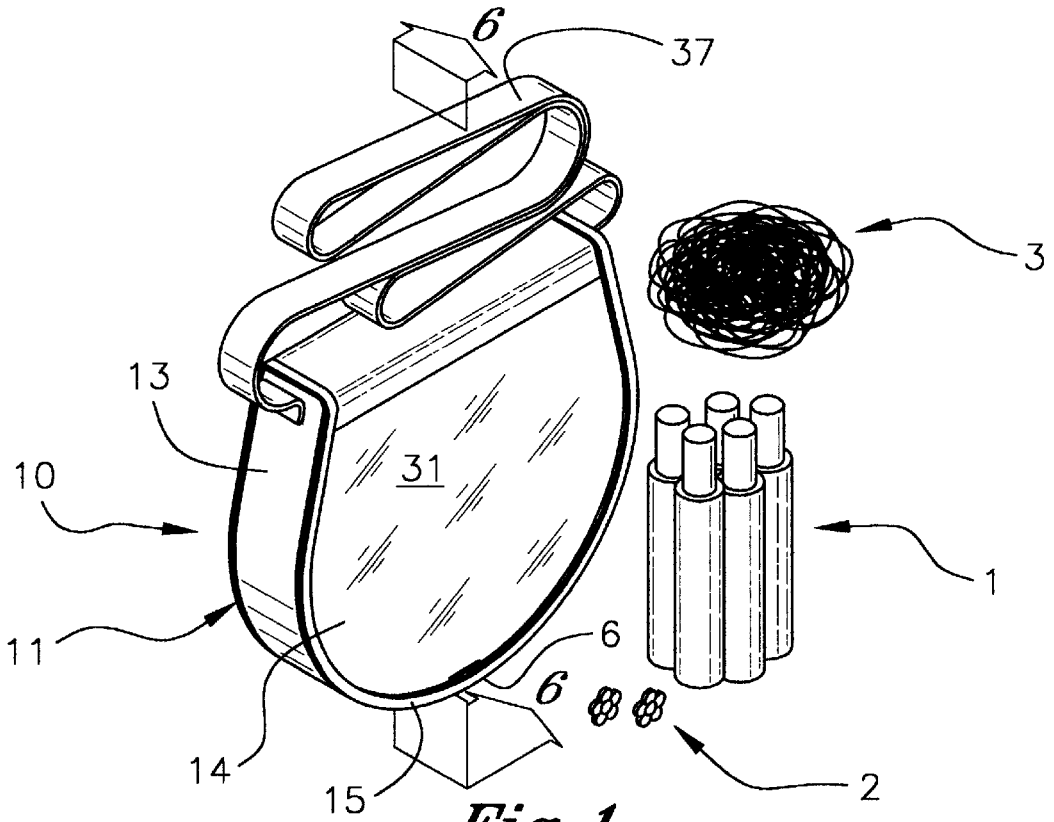
FIG. 1 shows a perspective view of the inventive purse with decorative materials adjacent thereto that will be used to decorate a panel thereof.

With reference, first, to FIG. 1, a set of markers suitable for use in marking a dry erasable board is generally designated by the reference numeral 1 and preferably includes a plurality of markers, each of which includes ink formulated to mark with a unique color. FIG. 1 also depicts decorative pieces 2 and a yarn-like material 3 that is used to create simulated hair.

Figure 2:
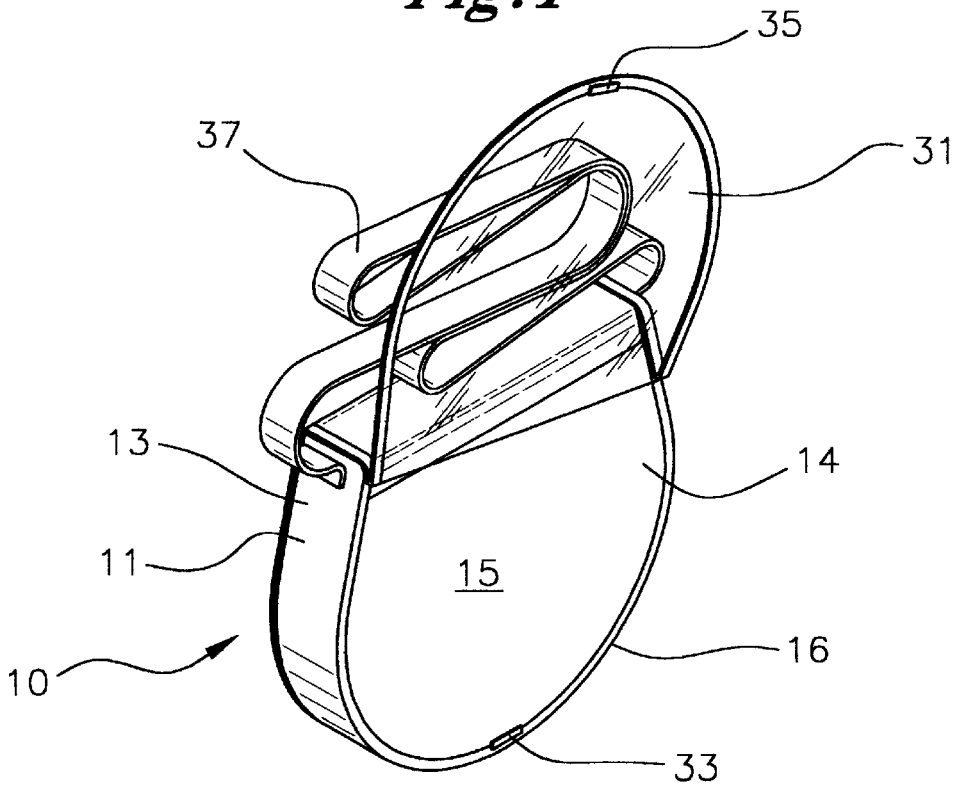
FIG. 2 shows a further perspective view of the purse illustrated in FIG. 1 with a transparent covering flap opened to reveal the panel to be decorated.
Figure 6:
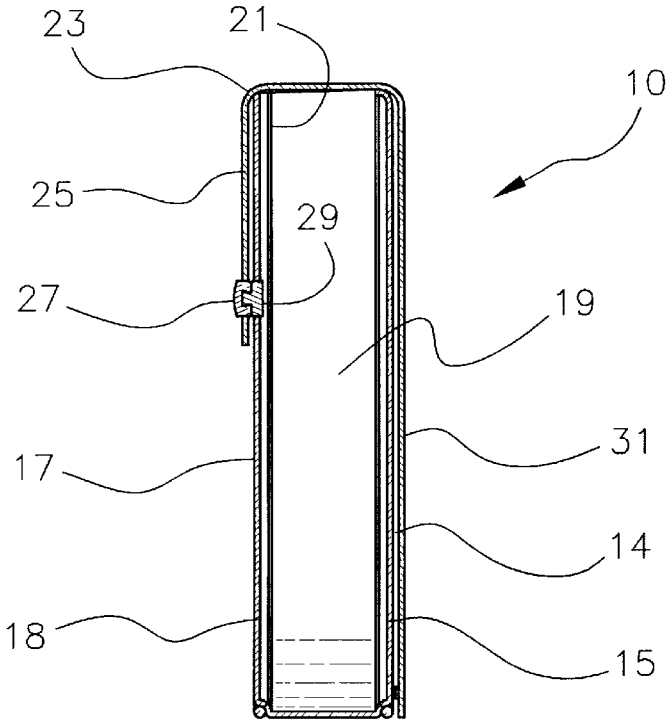
FIG. 6 shows a cross-sectional view along the line 6—6 of FIG. 1.

With further reference to FIGS. 1, 2 and 6, a purse in accordance with the teachings of the present invention is generally designated by the reference numeral 10 and is seen to include a U-shaped body 11 having a sidewall 13 and a rear wall 15 (FIGS. 2 and 6).

With further reference to FIG. 6, the purse 10 also includes a front wall 17 which, with the rear wall 15 and the sidewall 13, define an internal chamber 19 having an upwardly facing opening 21. A flap 23 overlies the opening 21 and extends downwardly at reference numeral 25 overlying a portion of the front exterior wall surface 18 of the purse 10. A female clasp half 27 is shown installed at a bottom portion of the flap 23 and mates with a male clasp half 29 that is mounted on the front exterior wall surface 18 of the purse 10 as seen in FIG. 6. The clasp halves 27 and 29 releasably engage one another frictionally in a manner well known to those skilled in the art.

As seen in FIGS. 1, 2 and 6, a transparent cover 31 overlies the rear wall 15 of the purse 10. As particularly seen in FIG. 2, an edge 16 of the rear wall 15 has affixed thereto one half 33 of hook and pile fastening means of which the other half 35 is affixed to an inner peripheral edge of the transparent cover 31. Thus, in the position of the cover 31 seen in FIGS. 1 and 6, in particular, the hook and pile fastening means halves 33 and 35 engage one another to hold the cover 31 in the position shown in FIG. 1.

A strap 37 is suitably attached at opposite ends of the sidewall 13 of the purse 10 so that the user may grasp the strap 37 when carrying the purse 10.

The rear exterior wall surface 14 of the purse 10 is made of a suitable dry erasable board. This material is provided so that the user may freely draw a design thereon using the set: of markers 1 (FIG. 1), which design may easily be erased to correct errors in the design or to completely eradicate the design so that a new design may suitably be drawn.

Figure 3:
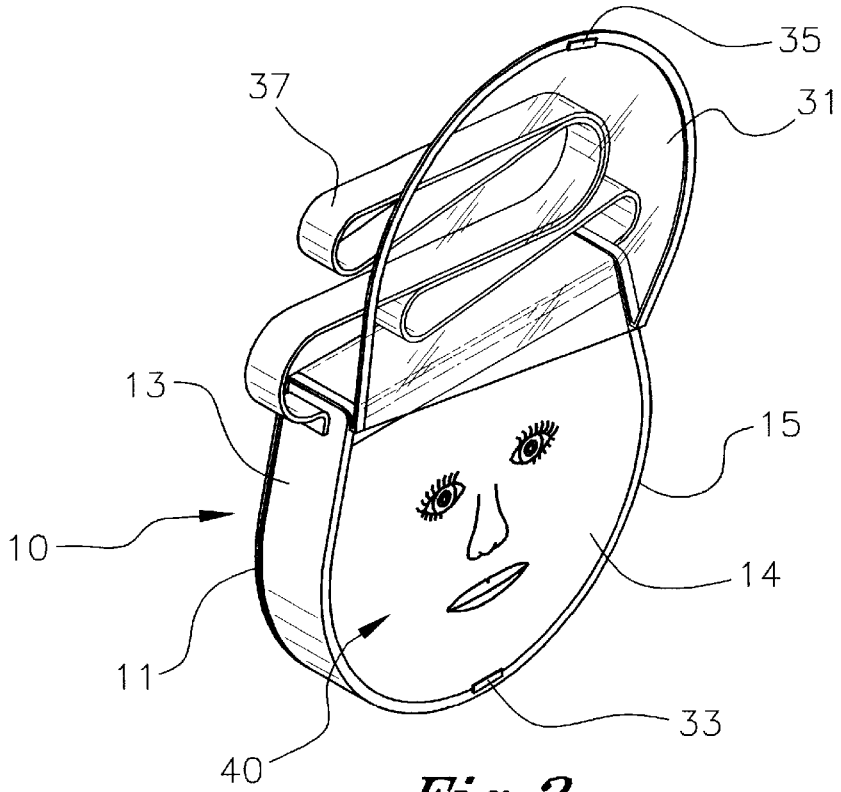
FIG. 3 shows a view similar to that of FIG. 2 but with the panel suitably decorated.
Figure 4:
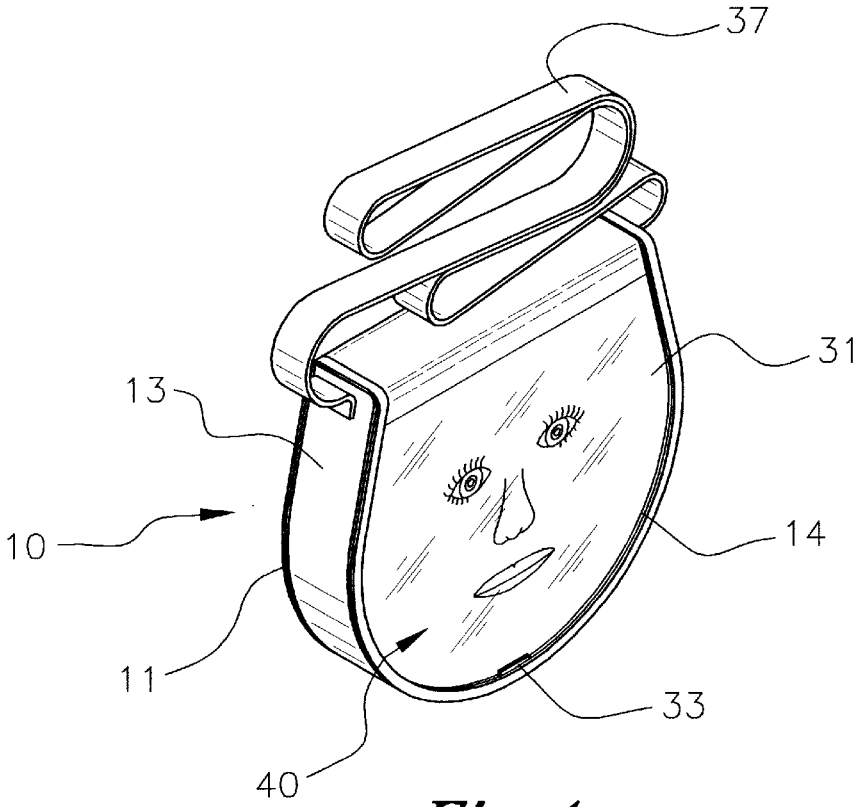
FIG. 4 shows the panel decorated as shown in FIG. 3 but with the flap in the position as shown in FIG. 1.
Figure 5:
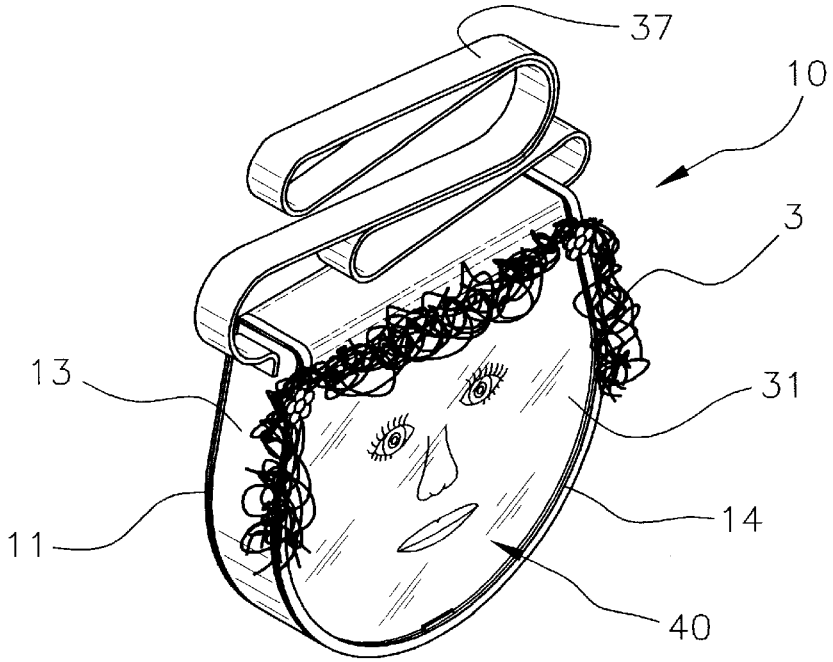
FIG. 5 shows a view similar to that of FIG. 4 but with additional decoration provided, consisting of artificial hair framing about the panel.

With reference to FIGS. 3, 4 and 5, the process for applying a design to the rear exterior wall surface 14 of the purse 10 is shown. First, the transparent panel 31 is lifted to the position shown in FIG. 3 (as is also shown in FIG. 2) and a design 40 is applied to the surface of the dry erasable board comprising the rear exterior wall surface 14. The design 40 is applied using the markers in the set of markers 1, or can be appliques including those made of self-adhesive paper, plastic, metal, or any other suitable material or can be painted thereon.

Thereafter, the transparent cover 31 is replaced to the position shown in FIG. 4 with the hook and pile fastening means halves 33 and 35 holding the cover 31 in the position shown. Thereafter, with reference to FIG. 5, the material 3 can be formed in a peripheral design resembling hair. The material 3 is applied as shown in FIG. 5 using any suitable means such as, for example, adhesive-backed tape as well as adhesives of any type or kind. Preferably, the adhesives employed to affix the material 3 in the manner shown in FIG. 5 should be chosen to ensure that the material 3 is easily removable if it is desired to change the design in any respect.

The transparent cover 31 is made of any appropriate material such as, for example, vinyl, acetate or any other type of strong, resilient, transparent plastic material. The purse 10 is made of any desired material such as, for example, plastic, leather or cloth.

The dry erasable board material used to make the rear exterior wall surface 14 is a well known material that does not allow permanent affixing of certain writing inks thereon. The transparent cover 31 prevents smudging or removal of applied ink from the surface of the wall 15 so long as it is desired to retain a particular design thereon.

As such, an invention has been disclosed in terms of a preferred embodiment thereof which fulfills each and every one of the objects of the invention as set forth hereinabove and provides a new and useful purse with a panel permitting custom decoration, of great novelty and utility.

Of course, various changes, modifications and alterations to the teachings of the present invention may be contemplated by those skilled in the art without departing from the intended spirit and scope thereof.

As such, it is intended that the present invention only be limited by the terms of the appended claims.

What is claimed is:

1. In a purse having an internal storage compartment, the improvement comprising a flat exterior wall surface of said purse made of a dry erasable material whereby a user can apply a decorative design thereto and erase said design as desired and a transparent cover overlying said flat exterior wall surface.

2. The purse of claim 1, wherein said cover is attached to said purse above said exterior wall surface and hangs over said exterior wall surface.

3. The purse of claim 2, further including fastening means for releasably fastening said cover over said exterior wall surface.

4. The purse of claim 3, wherein said fastening means comprises hook and pile fastening means, one half of which is affixed below said exterior wall surface and another half of which is affixed on a lower extreme of said cover.

5. The purse of claim 1, wherein said cover is made of plastic.

6. The purse of claim 1, further including a carrying strap.

7. The purse of claim 1, further including a closure for said internal storage compartment.

8. The purse of claim 7, wherein said internal storage compartment has an upwardly facing opening, said closure comprising a flap movable between a first position exposing said opening and a second position overlying said opening.

9. The purse of claim 8, further including a latch adapted to lock said flap in said second position thereof.

10. In a purse having a front wall surface and a rear exterior wall surface, an internal compartment having an upwardly facing opening, a flap movable between a first position exposing said opening and a second position overlying said opening, a latch adapted to lock said flap in said second position and a carrying strap, the improvement comprising said rear exterior wall surface being made of a dry erasable material whereby a user applies a decorative design thereto and can erase said design as desired, and a transparent cover overlying said rear exterior wall surface.

11. The purse of claim 10, wherein said latch is located on said front wall.

12. The purse of claim 11, wherein said cover is attached to said purse above said rear exterior wall surface and hangs over said rear exterior wall surface.

13. The purse of claim 12, further including fastening means for releasably fastening said cover over said rear exterior wall surface.

14. The purse of claim 13, wherein said fastening means comprises hook and pile fastening means, one half of which is affixed below said rear exterior wall surface and another half of which is affixed on a lower extreme of said cover.

15. The purse of claim 10, wherein said rear exterior wall surface is flat.

* * * * *